US012582246B2

(12) United States Patent
Kemp

(10) Patent No.: US 12,582,246 B2
(45) Date of Patent: Mar. 24, 2026

(54) WALL MOUNTED DISPLAY DEVICE WITH PROTECTIVE COVER

(71) Applicant: Vaulted Vinyl LLC, Waterloo, IA (US)

(72) Inventor: Shane A. Kemp, Washington, DC (US)

(73) Assignee: VAULTED VINYL LLC, Waterloo, IA (US)

( * ) Notice: Subject to any disclaimer, the term of this patent is extended or adjusted under 35 U.S.C. 154(b) by 0 days.

(21) Appl. No.: 18/748,272

(22) Filed: Jun. 20, 2024

(65) Prior Publication Data

US 2025/0325121 A1 Oct. 23, 2025

Related U.S. Application Data

(63) Continuation-in-part of application No. 29/938,486, filed on Apr. 22, 2024, now Pat. No. Des. 1,072,056.

(51) Int. Cl.

| | |
|---|---|
| ***A47F 7/28*** | (2006.01) |
| ***A47F 3/12*** | (2006.01) |
| ***A47F 5/08*** | (2006.01) |

(52) U.S. Cl.

CPC ..... *A47F 7/283* (2013.01); *A47F 3/12* (2013.01); *A47F 5/08* (2013.01)

(58) Field of Classification Search

CPC ... G09F 1/10; G09F 1/12; G09F 1/065; G09F 3/203; A47F 2007/0092; A47F 3/12; A47F 5/08; A47F 2003/008; A47F 7/283

See application file for complete search history.

(56) References Cited

U.S. PATENT DOCUMENTS

| | | | |
|---|---|---|---|
| 582,591 | A | 5/1897 | Salsberg |
| 680,451 | A | 8/1901 | Broadt |
| 1,011,747 | A | 12/1911 | Clark |
| D119,582 | S | 3/1940 | Williams |
| D120,223 | S | 4/1940 | Horsley |
| 2,278,866 | A | 4/1942 | Elba |
| 2,521,792 | A | 9/1950 | Hollander |

(Continued)

FOREIGN PATENT DOCUMENTS

| | | | |
|---|---|---|---|
| CA | 2119487 | A1 | 9/1995 |
| CH | 377493 | A | 5/1964 |

(Continued)

OTHER PUBLICATIONS

Amazon, "GosuToys Clear Plastic Protector Case Compatible for 4-inch Funko Pop Figures (40 Pack)," First reviewed Dec. 14, 2017. (https://www.amazon.com/Gosu-Toys-Plastic-Protector-Compatible/dp/B076VV1Z2K) (Year: 2017).

(Continued)

*Primary Examiner* — Patrick D Hawn
(74) *Attorney, Agent, or Firm* — BLANK ROME LLP

(57) ABSTRACT

A wall-mounted display device having a base member having a top surface with one or more recesses. Each recess is configured to retain a single collectible case. A frame member coupled to the base member, the frame member has one or more frame openings each aligned with a respective one of the one or more recesses to surround the respective one of the one or more recesses. A cover is coupled to the base member or the frame member. The cover protecting the collectible case retained in said one or more recesses.

19 Claims, 9 Drawing Sheets

(56) References Cited

U.S. PATENT DOCUMENTS

D174,380 S * 4/1955 Engels et al. ..... D6/559
D211,186 S 5/1968 Smith
3,813,799 A 6/1974 Caravello
3,869,829 A 3/1975 Chiosso
4,192,439 A 3/1980 Segal
D257,913 S 1/1981 O'Dair
D293,624 S 1/1988 Sherman
4,860,468 A * 8/1989 Cliborn ..... A47G 1/065 40/775
4,872,723 A * 10/1989 Kopf ..... B60N 3/002 206/557
4,964,514 A 10/1990 Wycech
D318,068 S 7/1991 Truc
5,046,616 A * 9/1991 Makowski ..... B65D 73/0007 40/772
5,074,593 A * 12/1991 Grosso ..... G09F 1/10 283/109
5,087,145 A 2/1992 Cooley
5,105,567 A * 4/1992 Real ..... G09F 7/10 40/776
5,119,574 A * 6/1992 King ..... G09F 5/04 206/39
5,150,792 A * 9/1992 Munroe ..... B42F 5/00 206/472
D332,528 S 1/1993 Neal
5,230,426 A 7/1993 Keefe
D337,887 S 8/1993 Feinbloom
5,232,089 A * 8/1993 Kim ..... G11B 33/0455 206/483
D340,803 S * 11/1993 Bradford ..... D6/560
D346,067 S 4/1994 Bell
D349,814 S 8/1994 Crisp
D353,716 S 12/1994 Schur
5,375,352 A * 12/1994 Morris ..... G09F 1/10 40/737
D358,253 S 5/1995 Wong
5,419,062 A * 5/1995 Polinski ..... G09F 7/10 40/124.4
5,462,167 A * 10/1995 Polinski ..... A45C 11/18 206/455
D375,123 S 10/1996 Strang
5,605,389 A 2/1997 Kelly
D380,612 S 7/1997 Kelley
D382,142 S 8/1997 Kelly
D388,963 S 1/1998 Williams
D393,875 S 4/1998 Brooks
D396,750 S 8/1998 Slater
5,787,626 A 8/1998 Bingham
D403,535 S * 1/1999 Wilbert ..... D6/661
D406,462 S * 3/1999 Emery, III ..... D3/276
D408,154 S 4/1999 Kacius
D421,051 S 2/2000 Jahn
D421,525 S 3/2000 Lee
6,036,019 A 3/2000 Silverman
6,039,495 A * 3/2000 Zimmerman ..... B42F 13/40 206/463
6,056,377 A 5/2000 Jeter
6,142,314 A 11/2000 Cotterill
D436,255 S 1/2001 Colby
6,282,826 B1 * 9/2001 Richards ..... G09F 3/20 40/775
6,349,491 B1 * 2/2002 Able ..... G09F 1/10 40/124.06
D456,620 S 5/2002 Vincent
6,401,931 B1 6/2002 Javell
6,447,079 B1 * 9/2002 Irwin ..... A47G 1/12 312/118
D463,911 S 10/2002 Chen
6,467,619 B1 10/2002 Leen
D467,425 S 12/2002 Hardigg
D467,426 S 12/2002 Hardigg
6,536,149 B1 * 3/2003 Phillips ..... G09F 1/10 40/768
D477,158 S 7/2003 Calcerano
D499,883 S 12/2004 Perella
D509,072 S 9/2005 Babich
6,945,785 B2 * 9/2005 Sohl ..... B43L 1/12 434/408
7,090,313 B1 8/2006 McMurray
D527,900 S 9/2006 Dewa
7,410,053 B2 8/2008 Bowen
7,418,796 B2 * 9/2008 Anastasio ..... A47G 1/065 40/772
D592,402 S 5/2009 Ahlgrim
D619,808 S 7/2010 Huang
D641,401 S 7/2011 Tewart
8,104,615 B2 1/2012 Liu
D660,371 S 5/2012 Fuchs
D669,684 S 10/2012 Johnson
D673,774 S 1/2013 Neuhaus
D677,465 S 3/2013 Cenzano
D693,155 S 11/2013 Wu
8,595,969 B1 * 12/2013 Wheelis ..... A47G 1/12 206/778
D697,168 S 1/2014 Rusten
8,813,403 B2 * 8/2014 Weinert ..... A45C 11/182 40/721
D720,930 S 1/2015 Neuhaus
D735,500 S 8/2015 Wu
D740,378 S 10/2015 Walsh-Gomez
D740,547 S 10/2015 Gorouvein
D758,075 S 6/2016 Quarry
D786,073 S 5/2017 David
D813,538 S 3/2018 Gabrielyan
10,212,926 B2 2/2019 Harrell
D847,540 S 5/2019 Hamilton
10,472,879 B1 * 11/2019 Galler ..... E05B 53/00
D873,003 S 1/2020 Beilman
D873,005 S 1/2020 Decarlo
D873,014 S 1/2020 Shechtman
10,603,464 B2 3/2020 Spens
D887,505 S 6/2020 Tumpson
D891,828 S 8/2020 Glaser
D891,829 S 8/2020 Glaser
10,847,060 B1 * 11/2020 Rose ..... G09F 15/0012
D928,893 S 8/2021 Razon
D936,746 S 11/2021 Peeters
D937,352 S 11/2021 Peeters
D938,166 S * 12/2021 Kemp ..... D3/286
D943,274 S 2/2022 Tortorella, Jr.
D963,339 S 9/2022 Cai
D982,910 S 4/2023 De Laurentiis
D991,483 S 7/2023 Mooney
D993,324 S 7/2023 Spiegel
D993,618 S 8/2023 Tortorella, Jr.
D1,011,747 S 1/2024 Li
D1,018,045 S 3/2024 Hattori
D1,029,500 S 6/2024 Thorn
D1,030,489 S 6/2024 Cox
D1,034,857 S 7/2024 Scarlett
2002/0069567 A1 * 6/2002 Marino ..... G09F 1/12 40/768
2004/0031700 A1 2/2004 Hanshaw
2004/0154204 A1 * 8/2004 Fu ..... G09F 3/20 40/661.01
2005/0198884 A1 9/2005 Rukminto
2006/0150464 A1 * 7/2006 Lindsey ..... G09F 1/12 40/735
2006/0260966 A1 11/2006 Lake
2009/0033183 A1 2/2009 Kester
2011/0082969 A1 4/2011 Macor
2011/0180452 A1 7/2011 Brandinelli
2014/0265789 A1 9/2014 Metzler
2015/0027017 A1 1/2015 Gregerson
2018/0272180 A1 9/2018 Abrahams
2020/0407144 A1 * 12/2020 Kemp ..... B65D 43/163
2022/0022623 A1 1/2022 Lee
2022/0125222 A1 * 4/2022 Hassanali Issa Hacamo ..... G09F 1/12
2022/0258947 A1 8/2022 Ramirez
2022/0270519 A1 8/2022 Fick

(56) References Cited

U.S. PATENT DOCUMENTS

| | | | | |
|---|---|---|---|---|
| 2022/0386791 | A1* | 12/2022 | Kemp | A47F 5/08 |
| 2023/0127622 | A1* | 4/2023 | Williams | A47G 1/06 40/711 |
| 2024/0285051 | A1 | 8/2024 | Kemp | |

FOREIGN PATENT DOCUMENTS

| | | | | |
|---|---|---|---|---|
| CN | 106429031 | A | 2/2017 | |
| CN | 209023319 | U | 6/2019 | |
| CN | 217447271 | U | 9/2022 | |
| DE | 4036469 | A1 | 5/1992 | |
| DE | 202017100549 | U1 | 5/2017 | |
| EP | 1051936 | A2 * | 11/2000 | A47G 1/0638 |
| GB | 2130420 | A * | 5/1984 | G09F 1/12 |
| GB | 2504667 | A | 2/2014 | |
| JP | D1255653 | | 11/2005 | |
| JP | D1255655 | | 11/2005 | |
| JP | 2006160333 | A | 6/2006 | |
| KR | 200261379 | Y1 | 1/2002 | |
| KR | 200329359 | Y1 * | 10/2003 | A47G 1/065 |
| KR | 20100004381 | U | 4/2010 | |
| KR | 200457289 | Y1 * | 12/2011 | B44C 3/085 |
| KR | 20130022222 | A | 3/2013 | |
| KR | 20140121579 | A * | 10/2014 | B43L 1/04 |
| KR | 200489090 | Y1 * | 4/2019 | G09F 1/10 |
| TW | M308259 | | 3/2007 | |
| TW | M308259 | U | 3/2007 | |
| WO | 2017088663 | A1 | 6/2017 | |

OTHER PUBLICATIONS

Facebook, Photos, User @VaultedVinyl. Posted Jun. 1, 02/2018. (https://facebook.com/pg/VaultedVinyl/photos/? ref=page_internal) (Year: 2018).

Ultra Pro, posted date unknown online, retrieved Aug. 8, 2024. Retrieved from internet https://www.amazon.com/ Ultra-PRO-ONE-Touch-Collectible-UV-Resistant/dp/BOB9344WM8/ref=asc_df_BOB9344WM8/?(Year: 2024).

Trading Card Display Frame, posted date unknown online, retrieved Aug. 8, 2024. Retrieved from internet https://www.amazon.com/ Standard-Protection-Acid-Free-Collector-Basketball/dp/ BOBY72XRQG/ref=sr_1_7? (Year: 2024).

https://www.amazon.com/dp/B08JSMP1WM/ref=sspa_dk_detail_0? psc=1&pd_rd_i=B08JSMP1WM&pd_rd_w=9zht8&content-id= amznl.sym.f734d1a2-0bf9-4a26- ad34-2e1b969a5a75&pf_rd_p= f734d1a2-0bf9-4a26-ad34-2e1b969a5a75&pf_rd_r= S8K6N7TV5VXEPG8BYTB4&pd_rd_wg=LXsXm&pd_rd_r= 152b2393-6890-4b1c-9e88-78d8f43e1980&s=home- garden&sp_csd= d21k Above reference prior art date: Sep. 23, 2020 Date found: Apr. 3, 2024.

https://www.amazon.com/gp/product/B00YUFZ1LY/ref=ewc_pr_img_1?smid=A1LJQBOJA6R2YV&psc=1 Prior Art Date: Jun. 4, 2015 Date found: Apr. 3, 2024.

"CASEMATIX Graded Card Case Pro Edition", photo reviewed on Mar. 2, 2022, Amazon.com, site visited Sep. 25, 2024: CASEMATIX Graded Card Case Pro Edition (Year: 2022).

"Custom Luxury Book Box Foam Case Inserts", first available Jul. 25, 2022, zouchconverters.co.uk, site visited Sep. 25, 2022: https:// zouchconverters.co.uk/news/2022/custom-foam-box-inserts (Year: 2022).

"The Display Vault Card Edition", photo reviewed on Oct. 26, 2023, vaultedcollection.com, site visited Sep. 25, 2024: https:// vaultedcollection.com/collections/vaulted-for-cards/products/the-display-vault-card-edition-personalized(Year: 2023).

"Graded Card Storage Box", first available Sep. 6, 2022, Amazon.com, site visited Sep. 25, 2024: https://www.amazon.com/Graded-Storage-Trading-Pokemon-Baseball/dp/B0B49VKPQN/ref=cm_cr_arp_d_product_top?ie=UTF8(Year: : 2022).

Trading card slab frame, retrieved from internet, [site visited on Jun. 6, 2024], URL:https://ridanco-displays.co.uk/products/9- graded-trading-card-slab-frame-white-39x29mm (Year: 2024).

Collectible card treasure, retrieved from internet, [site visited on Jun. 6, 2024], JRL:https://sportcard24.com/product/psa-book (Year: 2024).

Jewelry display, retrieved from internet, [site visited on Jun. 6, 2024], URL:https://shorturl.at/XmYQQ (Year: 2024).

Sorting_Tray_Grid_Display, retrieved from internet, [site visited on Jun. 6, 2024], URL: https://www.amazon.com/ Sorting-Display-Organizer-Finished-Compartments/dp/BOBVFY8K6V (Year: 2024).

The Display Vault Air Card Edition, retrieved online, [site visited Jan. 10, 2025], URL:https://www.youtube.com/watch? V=Jhd-y9Hu8KE (Year: 2024).

Casematix case; website "https://www.amazon.com/CASEMATIX-Storage-Compatible-Waterproof-Carrying/dp/B09S86839D/ref= fid= 3EMSZH4BYTHOE&dib=eyJ2ljoiMSJ9.WfG8lxveyOXleUHaRO x33mvdORfhqgaRH9T5ITACcSddDDet2PKL_2H2lbQSaBz1zunF hg5hYeCMqSQiASaopavC24C8Uz0pzvRNEx1vizUoO7Uz NAFSr";Date Captured: Mar. 25, 2025 (Year: 2022).

"Card Case", photo reviewed on Oct. 26, 2023, vaultedcollection.com, site visited Mar. 31, 2025: https://vaultedcollection.com/ products/ trading-card-case-the-display-vault-card-edition (Year: 2023).

* cited by examiner

WALL MOUNTED DISPLAY DEVICE WITH PROTECTIVE COVER

RELATED APPLICATION

This application is a continuation-in-part of U.S. Design application Ser. No. 29/938,486, filed Apr. 22, 2024.

BACKGROUND

A collectible is any item that has interest to a collector or is otherwise sought out by collectors. There are a wide range of collectibles, including freestanding collectibles and dependent (non-freestanding) collectibles. Freestanding collectibles can stand upright on their own without support. Figures or figurines are one type of freestanding collectible, such as Funko POPS!, and characters from movies, television, video games or pop culture. Often, figurine collectibles are similar in size to each other, but have very different shapes. However, the figurine collectible can be packaged in protective containers or boxes that have a standard shape. For example, figurine collectibles, and particularly Funko POPS!, are all different shapes but relatively the same size and can each be individually packaged in a box that has a rectangular cuboid shape and has a viewing window at at least a portion of the front of the box, such as shown in U.S. Pub. No. 2020/0407144. The figurine collectibles are configured to stand upright without support, and are elongated with a comparable length (x-direction), height (y-direction), and width or depth (z-direction). Likewise, the box packaging has a rectangular cuboid shape with a horizontally-extending (i.e., parallel to the bottom and top of the box, in the x-z plane) transverse cross section that is substantially square-shaped or slightly rectangular in shape, whereby the depth and width of the box provides sufficient support for the box to reliably stand upright on its own without support.

Trading card collectibles are a type of dependent (non-freestanding) collectible that has a growing community of collectors and can include, for example, sports cards (e.g., baseball), POKÉMON cards, and entertainment-related cards. Those collectibles are standard in size (width, height) and shape. For instance, trading card collectibles are rectangular and formed of a thin, flat, flexible, bendable, sheet made of laminated card stock with printing on one or both sides. Trading card collectibles are typically sold in smaller groups of single cards or 5-20 cards and packaged in a sealed wrapper, and are also sold in larger quantities of 50, 100 or 800 cards, and contained in a cardboard box. For example, baseball trading card collectibles are sold in packs of 4-16 cards, and also in boxes that hold 24, 30 or more packs per box, and a case can be used to hold multiple boxes. More valuable cards can be individually placed in a flexible bendable sleeve or a rigid case that are transparent so that the card can be viewed on one or both sides. As mentioned, individual trading cards are thin and flexible (small width, z-direction), and therefore unable to stand upright on their own. As shown in FIGS. 1(*a*), 4, a rigid plastic collectible housing, namely a protector case 7, can hold an individual trading card, but even those are not reliably freestanding due to the small width (z-direction), relative to its length and height, and are prone to falling over onto its front or rear face.

Collectors often store or view collectibles at various locations, such as their home, office, or events, and transport those collectibles between those locations. Collectibles are stored on a table or shelving, so that the collectible may be viewed by the collector. However, typical shelving does not protect collectibles from dust and damage from ultraviolet (UV) light or accidental dropping. Wall-mounted display cases or devices have been provided to display freestanding collectibles, as shown in U.S. Pub. Nos. 2020/0407144, and 2022/0386791, and U.S. application Ser. No. 29/786,160. In addition, wall-mounted display cases have been provided to display dependent collectibles, as shown in U.S. application Ser. Nos. 29/938,014, and 18/435,098, which are hereby incorporated by reference.

In addition, collectibles are often transported, for example to trading events, and then displayed at those events. Collectors typically transport collectibles in bags or boxes. Again, those collectibles are not protected from accidental damage unless the collector takes the time to wrap each individual collectible in a protective material. Portable carrying cases have been provided for freestanding collectibles that are contained in rectangular cuboid-shaped containers that can be used to transport collectibles between locations, such as shown in U.S. Pat. No. D938166, and U.S. Pub. Nos. 2020/0407144, 2022/0386791. Carrying cases have also been provided for trading card collectibles, such as shown in U.S. application Ser. Nos. 18/435,098 and 29/924,897. The entire contents of the patents and applications noted herein are hereby incorporated by reference.

SUMMARY

Conventional wall-mounted display cases do not protect the collectibles as they are being displayed. Accordingly, a wall-mounted collectible display device is provided that protects freestanding and dependent collectibles while those collectibles are stored, displayed, and/or transported. For collectibles having a standard size and shape, wall-mounted display devices may be specifically designed to protect collectibles of a standard size while those collectibles are stored, displayed, and/or transported.

This summary is not intended to identify all essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which:

FIG. 1(*b*) is a side view of the device shown in FIG. 1(*a*);

FIG. 2(*b*) is a rear view of the base member of FIGS. 1, 2(*a*);

FIG. 6(*b*) is a side view of the wall-mount device shown in FIG. 6(*a*);

FIG. 7(*b*) is a top view of another embodiment of the base member; and

FIG. 7(*c*) is a front view of FIG. 7(*b*).

Figure 1A:
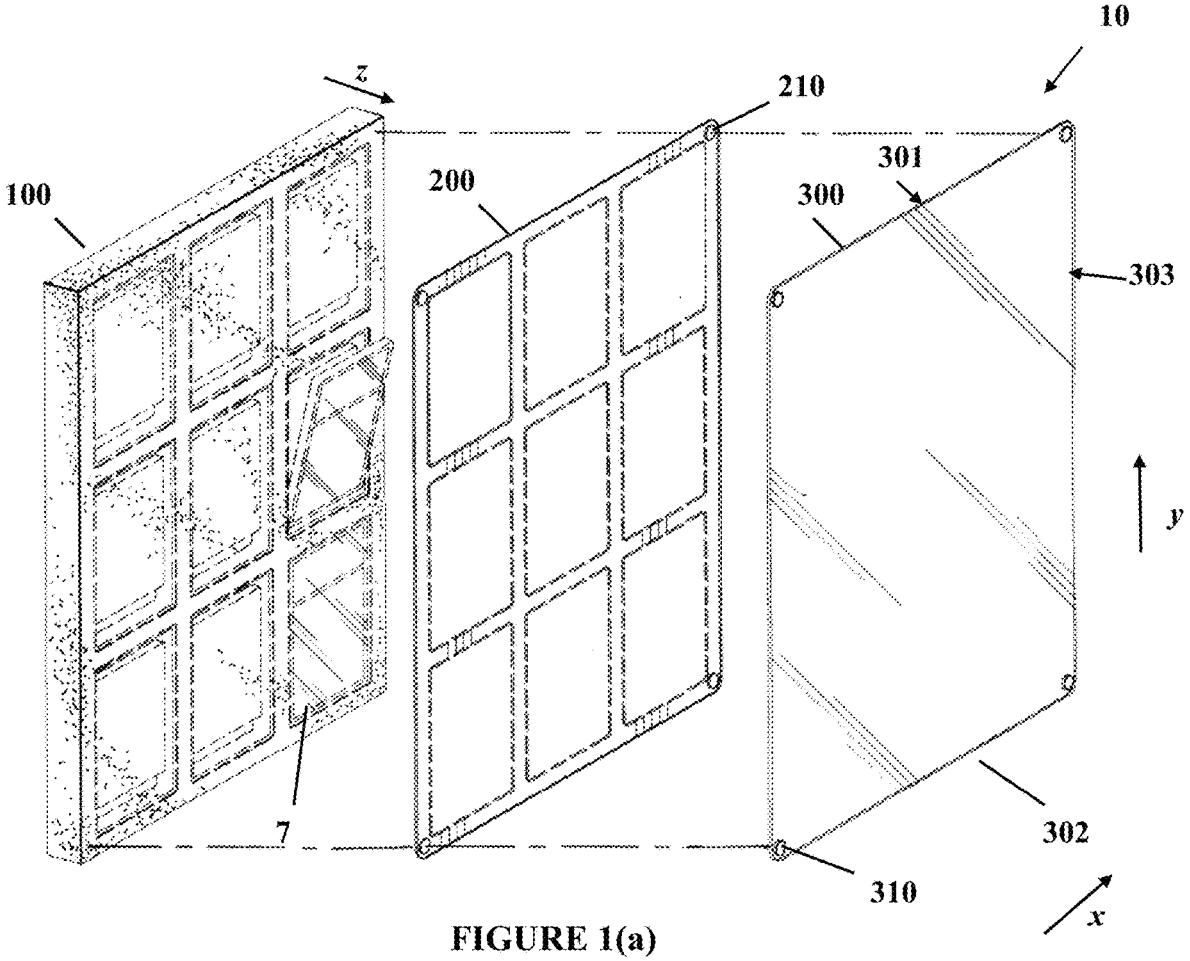
FIG. 1(*a*) is an exploded perspective view of an exemplary wall-mounted display device having a base member, frame member, and protective cover, according to one example embodiment of the present disclosure.

The figures show illustrative embodiment(s) of the present disclosure. Other embodiments can have components of different scale. Like numbers used in the figures may be used to refer to like components. However, the use of a number to refer to a component or step in a given figure has a same structure or function when used in another figure labeled with the same number, except as otherwise noted.

DETAILED DESCRIPTION

In describing the illustrative, non-limiting embodiments illustrated in the drawings, specific terminology will be resorted to for the sake of clarity. However, the disclosure is not intended to be limited to the specific terms so selected, and it is to be understood that each specific term includes all technical equivalents that operate in similar manner to accomplish a similar purpose. Several embodiments are described for illustrative purposes, it being understood that the description and claims are not limited to the illustrated embodiments and other embodiments not specifically shown in the drawings may also be within the scope of this disclosure.

Figure 1B:
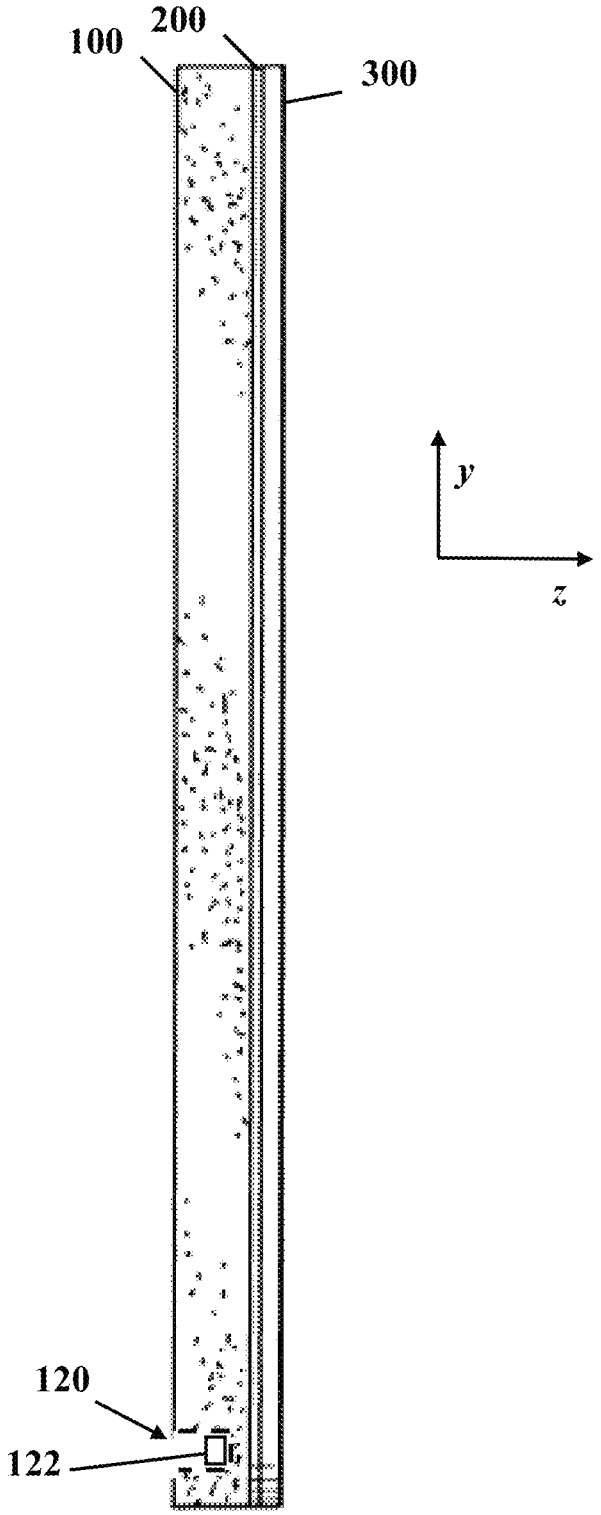

Turning to the drawings, FIGS. 1(*a*)-1(*b*) show a non-limiting illustrative embodiment of a wall-mounted display case or device 10 in accordance with the present disclosure. As shown, the wall-mounted display case 10 has a main body or base member 100, frame member 200, and protective cover 300. The base member 100 forms the main body with collectible retention elements, here shown as recesses 110, that receive and retain the collectibles, which are each housed in a collectible protector case 7, at a fixed position at the top surface 103 of the base member 100. The recesses 110 are configured so that a front surface of the protector case 7 faces forward so that the collectible, such as a trading card, is visible to the user through the cover 300, frame 200 and case 7.

The frame 200 is removably coupled to the planar top surface 103 of the base member 100, and has frame openings 204 that align with the recesses 110. The cover 300 is a thin transparent continuous panel or sheet that is removably coupled to the frame member 200, so that the frame member 200 is sandwiched between the main body 100 and the cover 300, to form (FIG. 1(*b*)) a bottom layer (base member 100), middle layer (frame member 200), and top layer (cover 300), or to form (FIG. 6(*b*)) a bottom layer (base member 100) and top layer (cover 300 (or frame member 200)). The cover 300 forms a barrier or shield over the base member 100 to further protect the collectibles and collectible cases 7 from being damaged or gathering dust or debris.

Figure 2A:
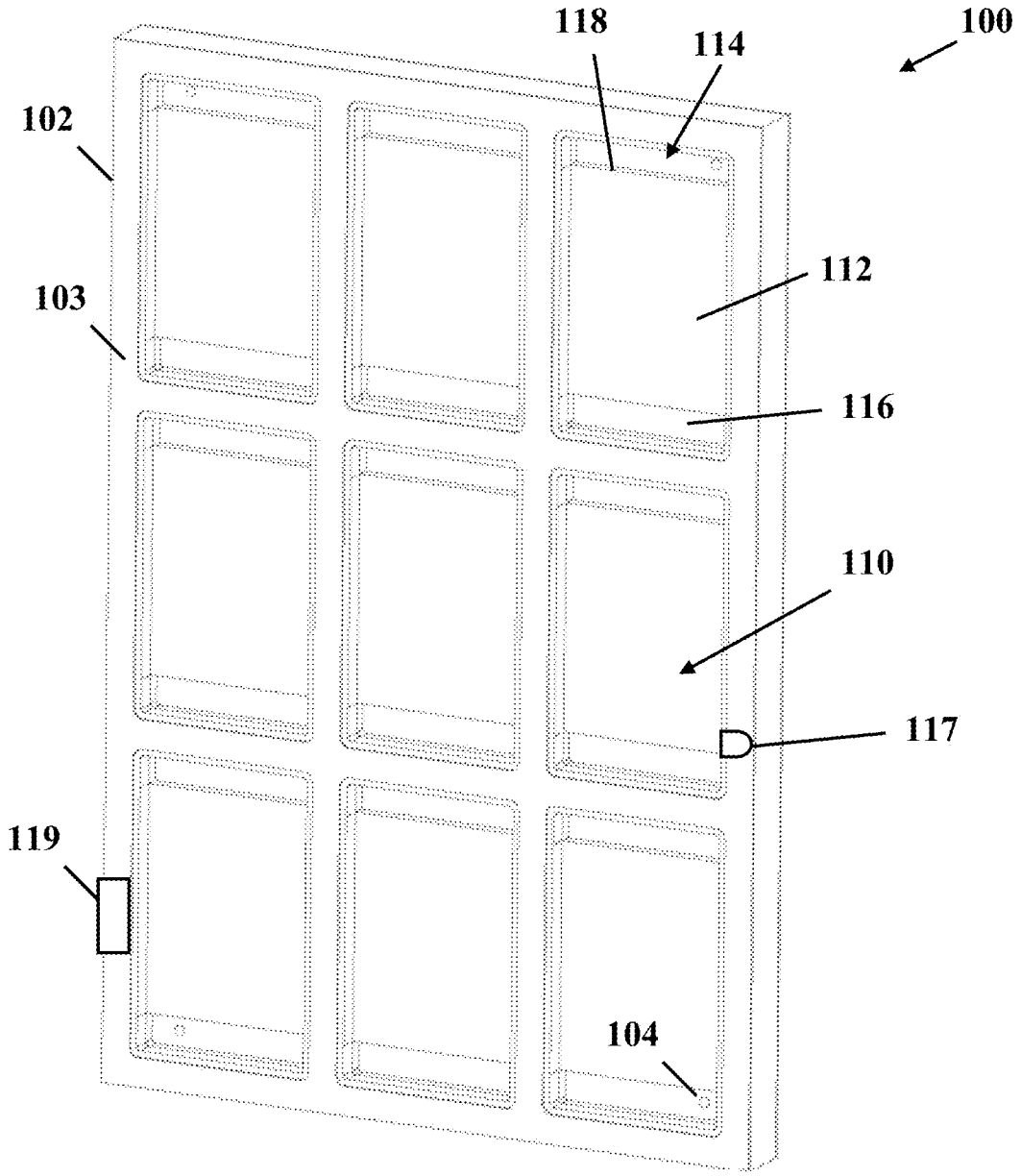
FIG. 2(*a*) is a front perspective view of the base member of FIG. 1.
Figure 2B:
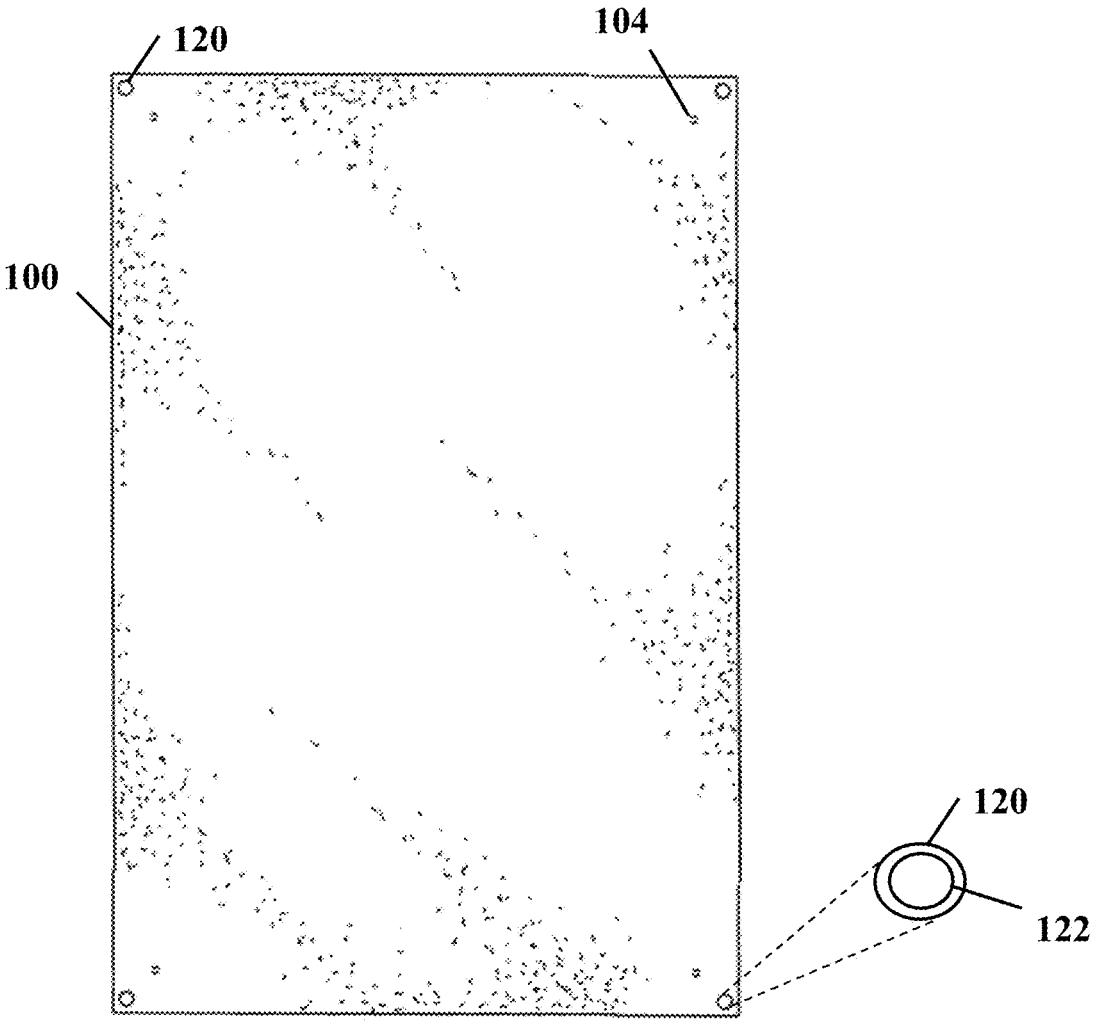
Figure 3:
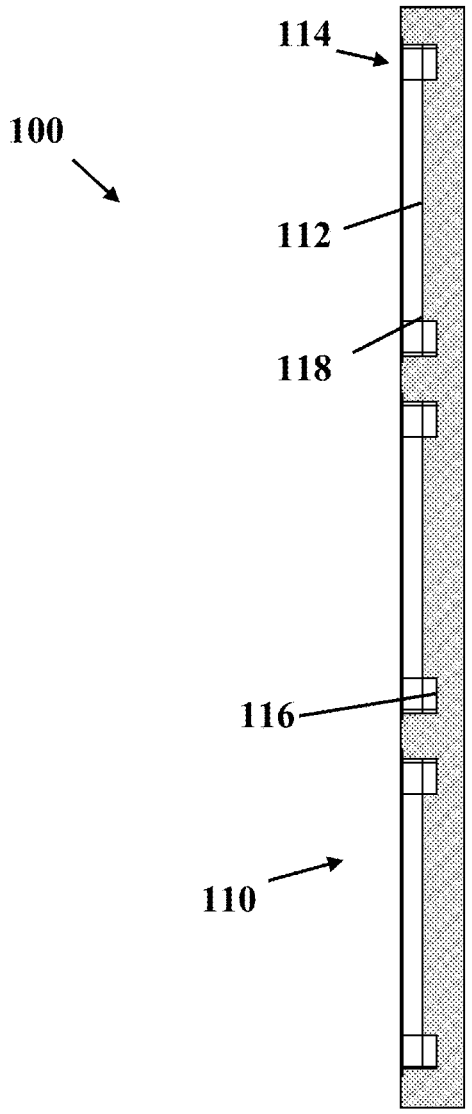
FIG. 3 is a side cutaway view of the base member of FIGS. 1, 2(*a*), 2(*b*)
Figure 4:
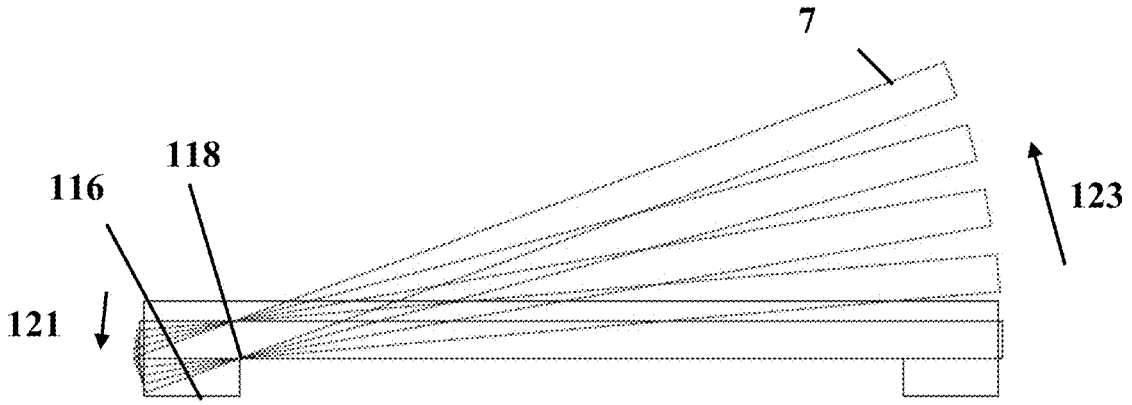
FIG. 4 is a side view showing different positions of the dependent collectible in a close-up view as the collectible is inserted and/or removed from one of the shaped recesses.

Base Member 100 (FIGS. 2-4)

The base member 100 is best shown in FIGS. 2-4. The base member 100 can be any suitable display case having a body 102 (for example, a foam) with one or more main body display openings or recesses 110. The base member 100 is flat with a planar top surface 103 and a planar rear surface, and can be a board. Each display recess 110 receives a single individual protector case 7 (FIGS. 1(*a*), 4), that retains a collectible, such as a freestanding collectible or a dependent collectible. When the collectible protector case 7 is received in the display recess 110, the top outer surface of the collectible protector case 7 is flush or recessed with respect to the planar top surface 103 of the base member 100. The display recess 110 has a flat or planar top surface 112 that is substantially parallel to the top surface 103 of the display case 100 and faces outward. A top channel 114 is formed at the top end of the recess 110, and/or a bottom channel 114 is formed at the bottom end of the recess 110. The channel 114 forms a bottom surface 116 that is parallel to the top surface 112 and further recessed with respect to the top surface 112. The lip or edge 118 is formed between the top surface 112 and the bottom surface 116.

The depth of the recess 110 can be adjusted so that the main body 100 can removably receive and retain a freestanding collectible or a dependent collectible. In the embodiment shown, the main body 100 receives a dependent collectible that is a flat card or sheet such as a baseball card, and housed in a collectible protector case 7. In a display configuration, the collectible is placed in the protector case 7, which is then placed in the display recess 110 and is held in place by a retention mechanism, such as for example the sides of the display recess 110 forming a friction fit. The collectible case 7 (as well as the collectible) has a top surface and bottom surface that are planar and parallel to the top and bottom surfaces 112, 116. When the user wants to remove the collectible, the user presses inward against the top or bottom ends of the collectible case 7. As illustrated in FIGS. 1(*a*), 4, if the top end is depressed, it pivots about the channel lip 118 and moves (as shown by arrow 121) into the top channel 114 at the top end of the recess, forcing the bottom end (as shown by the arrow 123) of the collectible outward at which point the bottom end can be grabbed by the user. If the bottom end of the collectible is depressed (i.e., pushed) inward, it pivots about the channel lip 118 and moves into the bottom channel at the bottom end of the recess, forcing the top end of the collectible outward at which point the top end can be grabbed by the user.

Thus, the base member 100 is provided for storage, and/or display of a collectible. As best shown in FIGS. 3-4, the case has a body 102, and one or more recesses 110 in the body configured to securely retain the collectible. In the example embodiment shown, the recesses 110 have a rectangular shape and is approximately the same size (that is, length (x-direction) and height (y-direction)) as the collectible case 7, though can be slightly smaller than the collectible case 7 to form a friction fit or slight larger than the collectible case 7. The recesses 110 are arranged in rows and columns, separated by a one or more horizontal and/or vertical dividing walls. However, any suitable configuration can be utilized, such as offset or in a circular pattern.

Each recess 110 has a first recess end (e.g., the top end) and a second recess end (e.g., the bottom end) opposite the first recess end. A channel 114 is formed at the first recess end and/or the second recess end. The channels 114 form a sturdy pivot point 118 adjacent the channel 114. A first collectible end (e.g., top end) of a single collectible case 7 is depressed, the single collectible case 7 pivots about the pivot point 118 to position the first collectible end into the channel and position a second collectible end (e.g., lower or bottom end) outside of the display recess for removal.

The recess has a recess surface 112 and the channel has a channel surface 116. The recess surface and the channel surface extend an entire width or length of the recess. The depth of the channel surface is greater than the depth of the recess surface. In addition, the collectible can have a collectible housing which is configured to removably receive the collectible, and the collectible alone or the collectible held inside the collectible housing (i.e., protector case 7) can be retained in the recess 110.

The wall-mounted display device 10 is configured to be hung and project outward from, a flat planar vertical wall, and not be mounted recessed within the wall. A wall-mounting feature (e.g., a hole 104 (FIGS. 2(*a*), (*b*)) and fastening device) can be located on the base member 100 to mount the case 10 to a wall structure. In the embodiment where there are a plurality of recesses 110 in the base member 100, each of the plurality of recesses 110 are configured receive a respective single one of a plurality of collectibles; for example, the recesses have the same shape as the collectible (or collectible housing) and a relatively same size (or either slightly smaller or larger than the collectible to form a reliable and suitable fit, such as a friction fit or snug fit). However, any suitable retention mechanism can be provided, such as a fastener, clip, clamp, adhesive, snap, or hook.

It is also noted that the collectibles shown and described are substantially rectangular. However, it will be recognized that the collectible can be any suitable collectible item having any suitable shape, such as a round coin or a spherical, oval, square, rectangular or polygonal toy, or the like. As such, each display recess 110 can have a shape sized to securely hold a coin, toy or other collectible having any particular shape. In addition, the collectible item can be located inside a protector such as a housing, or can be without a protector.

In addition, the base member 100 is made of a foam material. That material can be a soft or pliable foam, or can be a relatively sturdy foam that has sufficient rigidity to support and retain a collectible and/or be inserted and removed from the base member 100 to be wall-mounted. However, other suitable embodiments are envisioned, such that the material can be a rigid plastic, wood or other material. In other embodiments, the material can be a rigid plastic, metal, wood or other material, and have a foam lining that at least partly or fully formed about the walls of the recesses 110 to protect the collectible against damage and movement. The collectible protector case 7 is rigid and transparent, so that the collectible can be viewed through the front outer face (i.e., the top surface) of the collectible case 7. The collectible protector case 7 is thin and rectangular, such as to hold a trading card.

Turning to FIGS. 1(*b*), 2(*b*), a coupling mounting hole 120 is shown extending inward partially into the base member 100 from the rear facing side of the base member 100. The coupling mounting hole 120 does not extend all the way through the base member 100. Instead, a base coupling element, such as a magnet 122, is placed inside the mounting hole 120. The magnet 122 is located at the bottom of the mounting hole 120 closest to the front top surface 103 of the base body 102. The magnet 122 can be fixed in the hole 120, such as by friction fit or by an adhesive or fastening member, or a pliable (e.g., foam or rubber) plug inserted into the hole 120 after the magnet 122 is in place. In FIG. 1(*b*), the foam of the base member 120 is cutaway and only one hole 120 and magnet 122 is shown for illustrative purposes. As shown in FIG. 2(*b*), one or more holes 120 and magnets 122 are provided, such as at one or more or all four corners of the base member 100. In another embodiment, the holes 120 need not be provided, and instead the magnets 122 can be placed in a shallow recess located at the top surface 103, and fixed in the shallow recess such as by adhesive or a pliable plug. Or, a slot can be cut or formed in the top or side of the base member and the magnet 122 slid into the slot. The magnet 122 has a same shape as the hole 120 or recess, and can be slightly smaller than the hole 120 or recess.

In certain embodiments, one or more top layers can be positioned over the foam top surface 103. For example, the top layer(s) can be a veneer layer made of carbon fiber. The top layer is ornamental, and can have a design or text, but also provides support to add rigidity to the foam base layer 100 and adds protection, such as shown and described in US2022/0386791, which is hereby incorporated by reference. The magnets can be placed in openings in the top layer(s) or on a top surface of the top layers. It is further noted that the base layer 100 need not be foam, but can be of other material, such as wood or plastic, and covered with a foam or rubber layer to friction fit the collectible cases.

Figure 5:
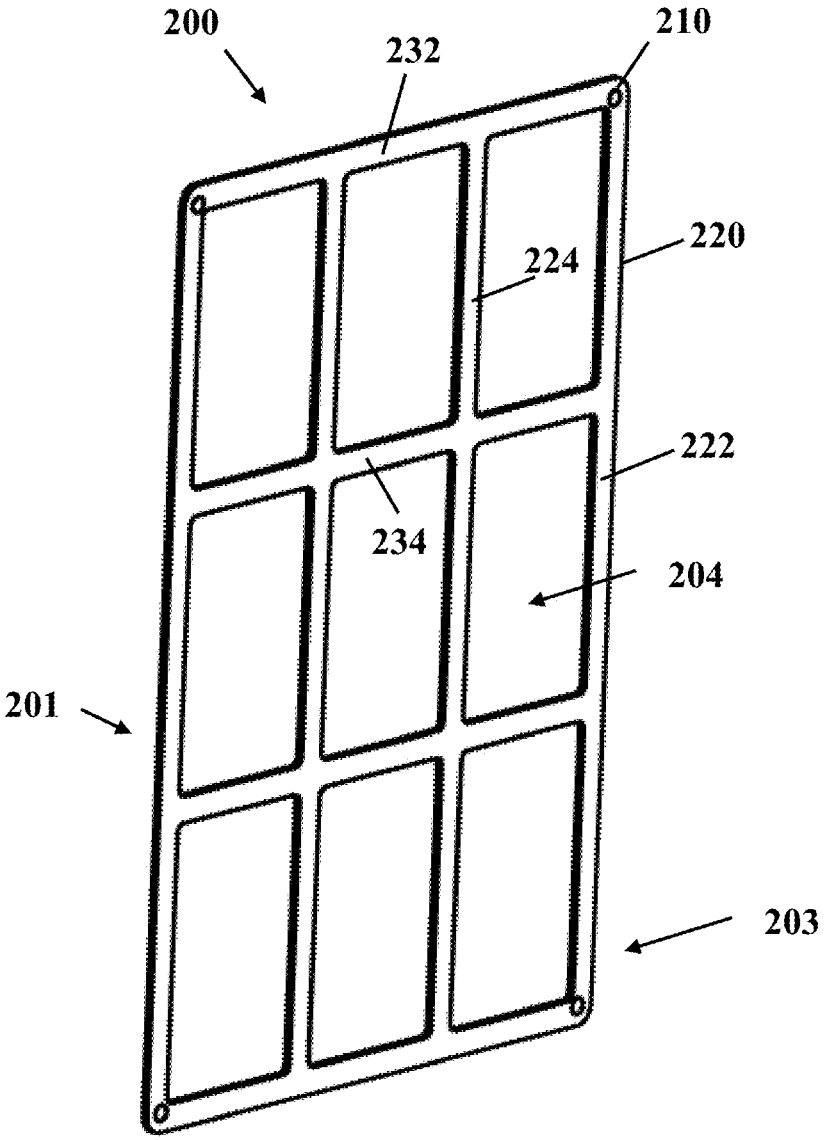
FIG. 5 is a front perspective view of the frame member of FIG. 1.

Frame Member 200 (FIG. 5)

Referring to FIGS. 1, 5, the frame member 200 is shown. The frame member 200 is flat and can be a sheet, and has the same size (that is, length (x-direction) and height (y-direction)) as the base member 100. As shown in FIG. 1(*b*), the frame member 200 has a substantially smaller width (z-direction) than the base member 100. The frame member 200 also has the same shape as the base member 100, here a rectangular shape. Of course, one skilled in the art will recognize that other suitable sizes, relative sizes, and shapes are within the spirit and scope of the present disclosure.

The frame member 200 has a body 220 formed of elongated vertical and horizontal outer side support members 222, 232 and one or more optional vertical and horizontal internal cross-support members 224, 234 (in those embodiments where more than one recess 110 and frame opening 204 are provided). The internal cross-support members 224, 234 cross one another and align with a respective base member vertical or horizontal dividing wall that is positioned between neighboring recesses 110. The support members 222, 232, 224, 234 cooperate to form one or more openings 204 that are arranged in rows and columns so that each of the frame openings 204 are aligned with a respective one of the base member recesses 110. Of course, other suitable configurations are provided, such as only horizontal internal cross-support members 234, or only vertical internal cross-support members 222.

The frame openings 204 can be slightly larger than the base member recesses 110, so that each recess 110 is framed or surrounded by the frame members. Or, the frame openings 204 can be slightly smaller than the base member recesses 110, so that the frame members 222, 232, 224, 234 help keep the collectible cases 7 in the recesses 110.

The frame member 200 is a rigid plastic and can be opaque or transparent so that the top surface of the base 100 (and any printed matter or design on the top surface) can be seen through the frame member 200, or can be other material such as glass, metal or wood. In some embodiments, the frame member 200 can be colored or have an artistic, ornamental or decorative pattern or display a message or logo.

The frame has a first planar inward-facing side 201, and a second planar outward-facing side 203 opposite the inward-facing side 201. One or more frame coupling members, such as frame magnets 210, are provided on the frame 200. The frame magnets 210 can be fixed in through-holes that extend through the frame body 202, such as by friction fit or by an adhesive or fastening member. Or, the frame magnets 210 can be adhered to the inward-facing or outward-facing sides 201, 203 of the frame body 202. Or, the frame magnets 210 can be positioned in shallow frame recesses formed in the inward-facing or outward-facing sides 201, 203 and fixed by an adhesive or fastening member. The frame magnets 210 are each aligned with a respective one of the base magnets 122, so that the frame magnets 210 are magnetically attracted to the base magnets 122 to couple the frame member 200 to the base member 100. In the embodiment shown, a frame magnet 210 is provided at each of the four corners of the frame member 200. The frame magnets 210 have a same size and shape as the base magnets 122. Still further, there can be a first set of one or more frame magnets 210 located on the inward-facing surface 201 that removable couple with the base magnets 122, and a second set of one or more frame magnets 210 located on the outward-facing surface 203 that removably and magnetically couple with cover magnets 310 (FIG. 1(*a*)).

Figure 6A:
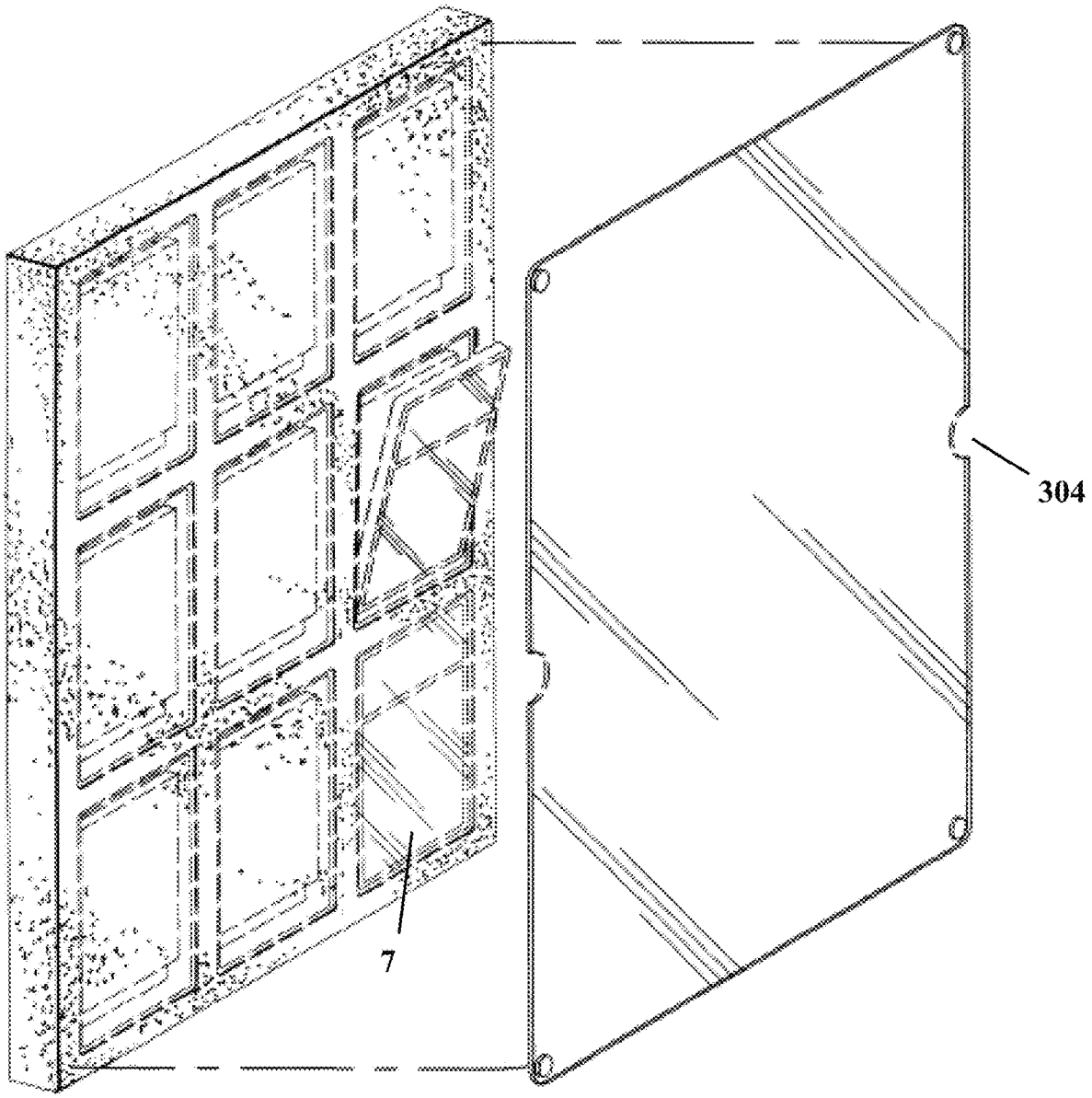
FIG. 6(*a*) is a front exploded perspective view of an exemplary wall-mounted display device having a base member, and protective cover, according to a further example embodiment of the present disclosure.
Figure 6B:
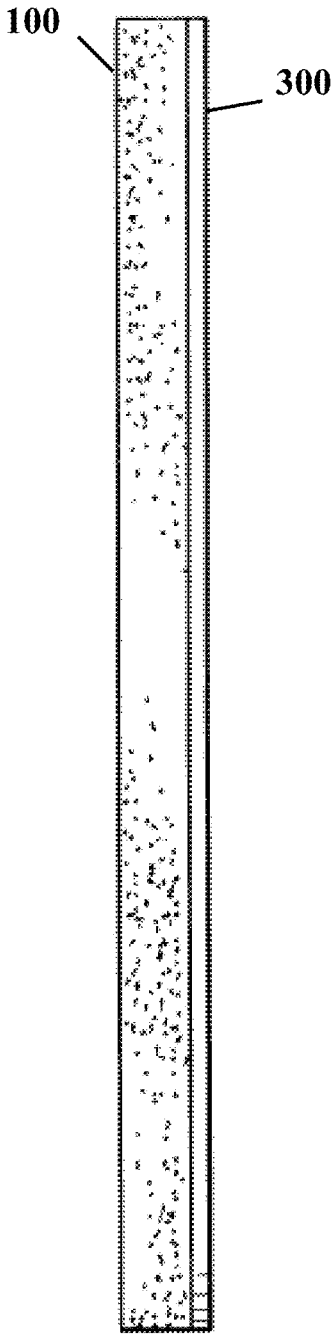

In the embodiment shown, magnets 122, 210 are utilized to removably couple the frame member 200 to the base member 100, so that (for example) the frame member 200 can be removed and replaced by a different color or stylized frame member 200, or removed altogether (FIG. 6). The magnets 122, 210 are easily engaged and disengaged with one another and provide a reliable coupling. For example, the user can slide the frame member 200 horizontally or vertically sideways on and off with respect to the base member 100 to engage and break the magnetic coupling. Or, the corners of the frame member 200 can be rounded to be inset from the base member corners, so that the user can grab one or more of the corners of the frame member 200. However, other suitable coupling elements can be provided, such as fasteners. Still further, the frame member 200 can be fixedly (not removably) coupled to the base member 100.

Protective Cover 300 (FIG. 1(*a*))

Referring to FIG. 1, the cover 300 is shown. The cover 300 has the same size (that is, length (x-direction) and height (y-direction)) as the frame member (when provided) and the base member 100. The cover 300 is flat and can be a sheet and, as shown in FIG. 1(*b*), has a substantially smaller width (z-direction) than the base member 100, though the cover 300 can have a slightly larger width than the frame member 200 since the cover 300 provides structural protection and the frame member 200 has more of an aesthetic appeal. The cover 300 also has the same shape as the frame member 200 and the base member 100, here a rectangular shape. Of course, one skilled in the art will recognize that other suitable sizes, relative sizes, and shapes are within the spirit and scope of the present disclosure.

The cover 300 has a body 302 is a thin planar sheet that is continuous and uninterrupted, and extends the entire height from the top to the bottom of the base member 100, and the enter length from the left to the right of the base member 100.

The cover 300 is a rigid plastic and transparent so that the top surface of the base 100 (and any printed matter or design on the top surface) and the collectible and collectible case can be seen through the cover 300, though in some embodiments can be glass. In some embodiments, the cover 300 can be colored or have an artistic pattern or display a message or logo at locations that do not block the base member recesses 110 or the collectibles positioned therein. The cover 300 protects the collectibles and collectible cases 7 to prevent damage to the collectibles and collectible cases 7, and prevent dust and debris from reaching the collectibles. In addition, the cover 300 can have a UV coating or protection to protect the collectibles and collectible cases 7 from sun or light damage. The cover 300 can also be shatterproof to provide greater protection.

The cover 300 has a first planar inward-facing side 301, and a second planar outward-facing side 303 opposite the inward-facing side 301. One or more cover coupling members, such as cover magnets 310, are provided on the cover 300. The cover magnets 310 can be fixed in through-holes that extend through the cover body 302, such as by friction fit or by an adhesive or fastening member. Or, the cover magnets 310 can be adhered to the inward-facing or outward-facing sides 301, 303 of the cover body 302. Or, the cover magnets 310 can be positioned in shallow cover recesses formed in the inward-facing or outward-facing sides 301, 303 and fixed by an adhesive or fastening member. The cover magnets 310 are each aligned with a respective one of the frame magnets 210, so that the cover magnets 310 are magnetically attracted to the frame magnets 210 to couple the cover 300 to the frame member 200. In the embodiment shown, a cover magnet 310 is provided at each of the four corners of the frame member 300. The cover magnets 310 have a same size and shape as the frame magnets 210.

Accordingly, the frame magnets 210 have a first side that couple to the base magnets 122 and at the same time have a second side that couple to the cover magnets 310. In addition, in the embodiment of where the frame member 200 has a first set of frame magnets 210 located on the inward-facing surface 201 of the frame and a second set of one or more frame magnets 210 located on the outward-facing surface 203 of the frame member 200, the cover magnets 310 removably and magnetically couple with the second set of cover magnets 310 located on the outward-facing surface 203 of the frame member 200.

In the embodiment of FIG. 1(*a*), magnets 210, 310 are utilized to removably couple the frame member 200 to the cover 300, so that (for example) the cover 300 can be positioned over frame member 200 and the base member 100 to completely cover all of the base member recesses 110 to shield and protect the collectibles and collectible cases 7. The cover 300 can be removed and replaced by a different color or stylized cover 300, or removed altogether. The frame and cover magnets 210, 310 are easily engaged and disengaged with one another and provide a reliable coupling. For example, the user can slide the cover 300 horizontally or vertically sideways on and off with respect to the frame member 200 to engage and break the magnetic coupling. However, other suitable coupling elements can be provided, such as fasteners. Still further, the cover 300 can be fixedly (not removably) coupled to the frame member 200.

In operation, still referring to FIG. 1(*a*), the collectibles 7 are placed into the recesses 110. The user then slides the frame member 200 into position on the base member 200, and the frame magnets 210 engage the base magnets 122. The magnets 210, 122 align the frame member 200 with the base member 100, so that the frame openings 204 are aligned with the base recesses 110. The user then slides the cover 300 into position over the frame member 200, and the cover magnets 310 engage the frame magnets 210. The magnets 210, 310 align the cover 300 with the frame member 200, so that the cover 300 is aligned with the frame member 200 and the base member 100. The outer top, bottom, and side edges of the cover 300 can be flush with (or slightly inset from) the outer top, bottom, and side edges of the frame member 200 and also with the outer top, bottom, and side edges of the base member 100. In other embodiments, the frame member 200 can be coupled with the cover 300 first, and then the coupled frame member 200 and cover 300 can be placed over the base member 100 and coupled with the base member 100. To remove the cover 300 and frame member 200, the user proceeds in the reverse manner.

In some embodiments, the frame member 200 is optional and need not be provided, such as shown in FIGS. 6(*a*), 6(*b*). Here, the cover 300 directly couples with the base member 100, whereby the cover magnets 310 magnetically and removably couple with the base member magnets 122. The magnets 310, 122 align the cover 300 with the base member 100, so that the outer top, bottom and side edges of the cover 300 can be flush with (or slightly inset from) the outer top, bottom, and side edges of the base member 200.

In other embodiments, the cover 300 is optional and need not be provided. Instead, the frame member 200 is coupled with the base member 100 by themselves, and without the cover 300. In addition, though a single frame member 200 and a single cover 300 are shown to extend the entire height and length of the base member 100, there can be multiple frame members 200 and/or multiple covers 300, each of which are smaller than the base member 100 and only cover a portion of the base member 100. For example, a first frame member 200 (and/or cover 300) can be provided that only covers the top row of the base member recesses 110, and a second frame member 200 (and/or cover 300) can cover only the bottom row of the base member recesses 110, and the middle row of the base member recesses 110 can be uncovered by the first and second frame members 200 (and/or cover 300). In that example embodiment, magnets would be located on the base member 100, frame member 200, and cover 300 aligned with the corners of the top and bottom rows of the base member recesses 110.

FIG. 6(*a*) further shows finger removal slots 304 formed in the cover 300. Here, two finger slots 304 are shown, each on an opposite longitudinal side edge of the cover 300, about midway from the top to the bottom. When the cover 300 is coupled to the base 100 and/or frame 200, the user can use the finger slots 304 to more easily grab the cover 300 and remove the cover 300 from the base 100 and/or frame 200. In addition, finger openings (such as 117 (FIG. 2(*a*)) can be provided in the base member 100, at the cover finger slots 304 or even without cover finger slots. It is further noted that while two finger slots 304 are shown, only one need be provided, or more than 2 can be provided. The finger slot(s) 304 can be located at any suitable position on the cover.

The base magnets 122, frame magnets 210, and cover magnets 310 cooperate to provide a tactile and audible clicking sound. As the magnets draw near to one another, they magnetically attract and emit the audible sound, which indicates to the user that the base member 100, frame member 200, and/or cover 300 are coupled to one another. The magnets further confirm that the base member 100, frame member 200, and/or cover 300 are properly aligned with one another, because the magnets only engage one another when the base member 100, frame member 200, and/or cover 300 are in the proper position. In some embodiments, the magnets can be magnetically arranged or otherwise positioned so that the frame member 200 and cover 300 only engage the base member 100 in the proper position; that is, that the frame member 200 and/or cover 300 will not engage each other or the base member 100 if one or more of them are inverted with respect to the other. And while magnets 122, 210, 310 are shown at the four corners of the base member 100, frame member 200 and cover 300, more or fewer magnets can be provided, and magnets can be located at other positions.

Referring again to FIGS. 1(*a*), 6(*a*), a collectible and/or collectible case 7 is shown positioned in the bottom right recess 110 of the base member 100. The outer top surface of the collectible and/or collectible case 7 is flush with or recessed with respect to the top surface 103 of the base member 100, so that the frame member 200 and/or cover 300 can be placed over the base member 100. Another collectible case 7 is shown in the middle right recess 110 of FIG. 1(*a*), partially extending out of the recess 110, such as during insertion or removal of the case 7 from the recess 110 of the base member 100.

Referring to FIG. 2(*a*), one or more finger slots or channels 117 can be formed in the base member 100 that extends into the top surface 103 of the base member 100. Accordingly, when the frame member 200 and/or cover 300 are coupled to the base member 100, the user can slide a finger into the finger channel 117 beneath the frame member 200 and/or cover 300, to more easily grab the frame member 200 and/or cover 300, and lift the frame member 200 and/or cover 300 to remove the frame member 200 and/or cover 300 from the base member 100.

It is further noted that the wall-mounted display device 10 is stackable. Multiple display devices 10 can be stacked one on top of the other. The forward or outward-facing side of the cover magnets 300 can engage the rearward or outward-facing side of the base magnets 122, so that the front of the cover 300 of one device 10 engages the rear of the base member 100 of another device 10.

The wall-mounted device 10 is portable, and a user can travel with the device 10. In some embodiments, an opaque cover 300 can be utilized to avoid passersby from seeing the collectibles. A handle can be provided on the base member 100, such as at a top, side, bottom, or back, for easy carry of the device 10 during transport.

As further shown in FIG. 2(*a*), a locking feature 119 can be provided on the base member 100 that lockingly engages the frame member 200 (if present) and/or cover 300. The locking feature 119 locks the cover 300 to the base member 100, so that the cover 300 cannot be removed from the base member 100. That protects the collectibles against theft. That also prevents the cover 300 from inadvertently slipping off of the base member 100 during travel. The locking apparatus 119 can also lock the base member 100 to the wall, or a separate locking apparatus can be provided to lock the base member 100 to the wall. In addition, a mating locking feature can be provided on the cover 300 to facilitate locking of the base member 100 to the cover 300. Any suitable locking feature 119 can be provided, such as a physical lock that has a locking arm in the base member 100 that extends or rotates to engage a hole or plate in the cover 300. In addition, the locking feature 119 can be operated by a physical key, electronic key fob that is actuated (locked and unlocked) by an electronic keycard or phone or electronic signal, or a biometric reader that is actuated by the user's thumbprint, eye scan, facial recognition, or other. Still further, other suitable locking features 119 can be utilized within the spirit and scope of the present disclosure. In addition, multiple locks can be positioned about the display device 10.

It is further noted that while magnets 122, 210, 310 are utilized for the coupling elements, other suitable coupling elements or combination of coupling elements can be utilized such as, for example, a metal plate (e.g., the base coupling element 122 can be a metal plate and the cover base coupling element 310 can be a magnet that magnetically couples with the metal plate) screws, clips, custom fasteners, or VELCRO. It is further noted that the coupling elements 122, 210, 310 are provided on each of the base member 100, frame member 200, and cover 300, respectively, and cooperate to engage one another. In other embodiments, a single coupling element can be provided on one of the base member 100, frame member 200, or cover 300 only, that engages the other members. For example, a coupling element (such as a physical fastener such as a clip or clamp) can be provided on the base member 100 that removably engages the frame member 200 and/or the cover 300. In addition, the frame member 200 need not have a coupling element 210, but rather the cover 300 can retain the frame member 200 in position between the base member 100 and the cover 300. In addition, the frame member 200 can only couple with the cover 300, and the cover 300 couple with the base member 100. In addition, the frame member 200 can be formed internal to the cover 300.

In the embodiments shown and described, the base member 100, frame member 200 and cover 300 are separate or discrete pieces that are entirely disconnected from one another. That is, the device 10 has an opened configuration whereby the cover 300 and/or frame 200 are removed from the base member 100, and a closed configuration whereby the cover 300 and/or frame 200 are coupled (e.g., magnetically coupled) to one another. In the opened configuration, the base member 100, frame 200 and cover 300 are entirely separate and disconnected from each other. The recesses 110, collectibles or collectible cases are unprotected and can be inserted into and removed from the recesses 110. In the closed configuration, the cover 300 and/or frame 200 extend over and parallel to the top surface 103 of the base member 100 so that the cover 300 protects and the frame 200 frames, the recesses 110 and the collectibles or collectible cases cannot be accessed. In the closed configuration, the base member 100, frame 200 and cover 300 are still separate discrete pieces, but are removably coupled to one another.

It is further noted that the cover magnets 310 and frame magnets 210 (when the frame 200 is provided), are magnetically attracted to the base magnets 122 with sufficient force that the cover 30 and frame 200 are rotatably coupled. That is, the user can pull outward on the right side of the cover 300 and magnets 310, 210, 122 at the left side of the device 10 will separate a small distance but still have sufficient magnetic attraction that the left side of the cover 300 and frame 200 remain coupled to the left side of the base member 100. In addition, as noted above, certain collectibles such as trading cards, are not freestanding. Accordingly, the friction fit of the collectible cases within the recesses 110 prevent the collectible cases from inadvertently falling out of the recess 110. Thus, the magnets 310, 210, 122 operate as a hinge so that the user can open the cover 300 with one hand and access the collectible cases stored therein, and remove or insert a collectible case with the other hand.

In other embodiments, the cover 300 and/or frame member 200 can be rotatably coupled to the base member 100 to move been an open configuration and a closed configuration. For example, one or more hinges can be coupled to the base member 100 and the cover 300 and/or frame member 200. The hinge(s) can be placed along the side edge (left or right) of the base member 100 and cover 300 and/or frame member 200, and a coupling element (for example a magnet or fastener) can optionally be provided on the opposite side of the base member 100, cover 300 and/or frame member 200 to releasably couple the cover and/or frame member to the base member 100. In the closed configuration, the cover 300 and/or frame 200 extend over and parallel to the top surface of the base member 100 so that the cover 300 protects and the frame 200 frames, the recesses 110. In the open configuration, the cover 300 and/or frame 200 rotate about the hinge(s) to be angled with respect to the top surface of the base member 100, so that the collectibles or collectible cases can be inserted and removed from the recesses 110. The base 100, cover 300 and/or frame are still connected to each other on at least one side by the hinge, but are separate pieces, and are disconnected on all but one side. For example, where the base and cover have four sides (e.g., left, right, top, bottom), three sides are disconnected. It is noted that a side refers to a position on the device 10, and not the number of side walls. For example, where the base and cover are a circle or other shape having a single outer perimeter or side wall, it still has at least four sides (left, right, top, bottom) and is also disconnected on all but one side.

In some embodiments, a single cover 300 and/or a single frame member 200 need not extend across the entire front face of the base member 100, but multiple covers 300 and/or frame members 200 can be provided. For example, two covers 300 and/or frame members 200 can extend the entire height (vertical y-direction) of the base member 100, but only one-half of the length (x-direction). The two covers and/or frame members can meet in the middle (or along one column member), and one or both of the covers and/or frame members can be rotationally coupled to the base member, such as by a hinge or the like.

It is further noted that in any of the embodiments noted herein, one or more handles can be mounted to the cover 300 and/or frame member 200, in addition to or instead of the finger holes.

Figure 7A:
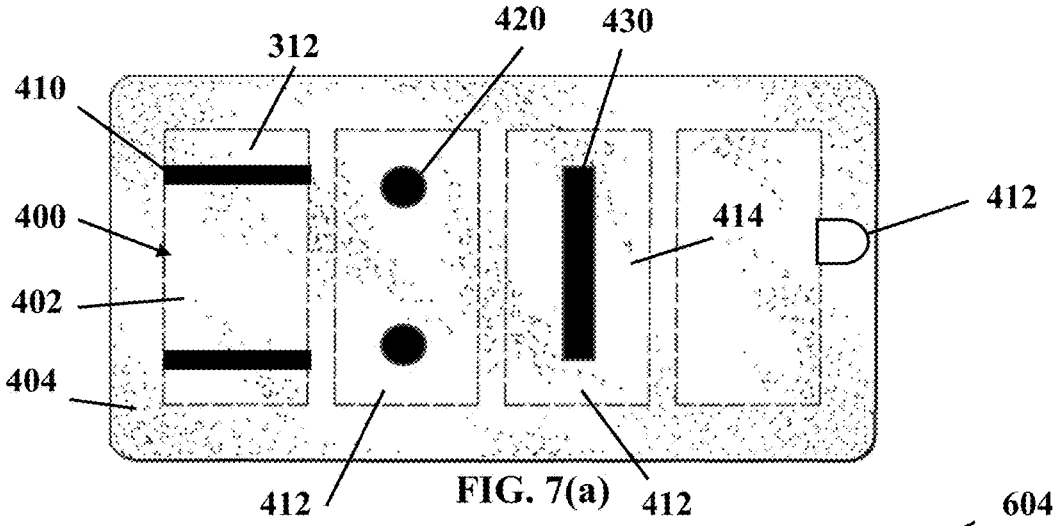
FIG. 7(*a*) is a front view of another embodiment of the base member.
Figure 7B:
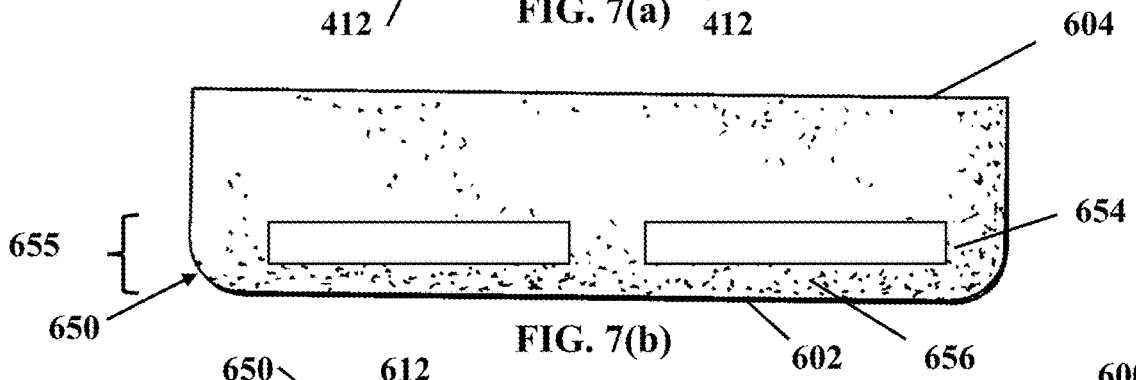
Figure 7C:
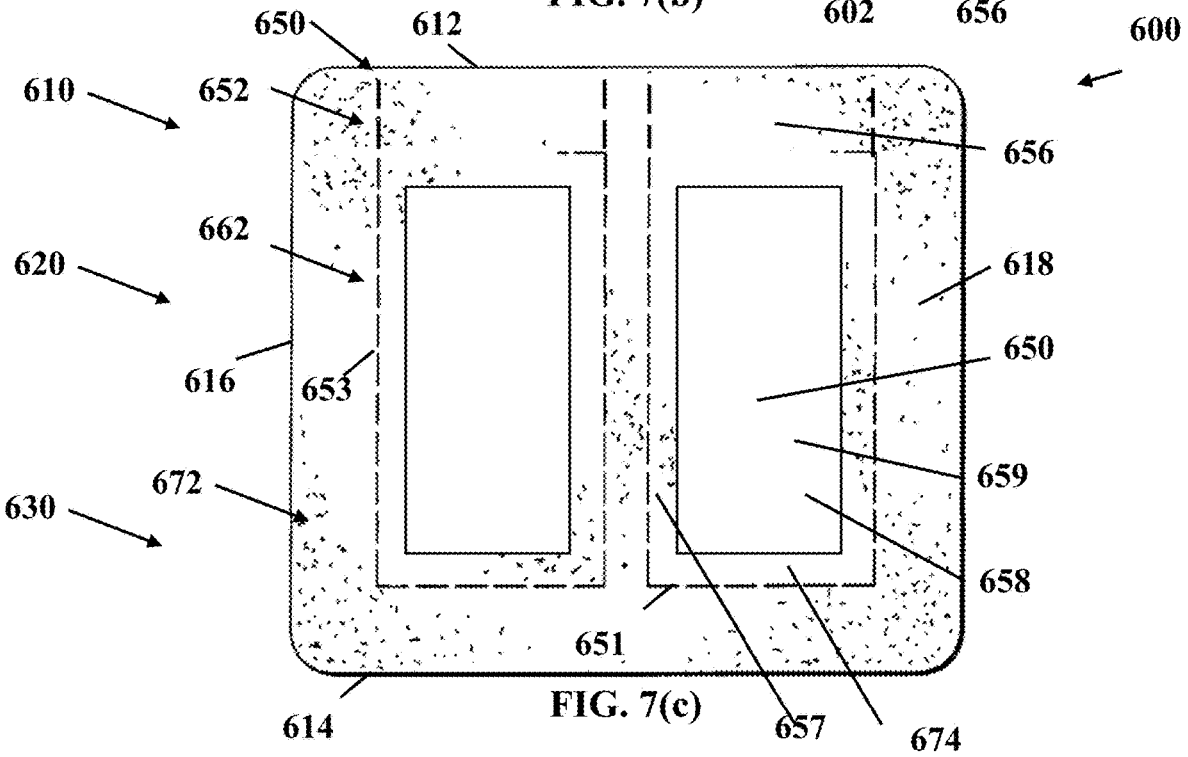

Still further, the embodiments of FIGS. 1-6 show nine recesses 110 arranged in three rows and three columns. However, any suitable number of recesses 110 can be provided, more or less than nine (including one recess) and arranged in other manners, such as in a circle. FIG. 7(*a*) illustrates four recesses arranged in a single row, and FIGS. 7(*b*), (*c*) illustrate two recesses arranged in a single row.

Collectible Removal Features

In the above embodiments, the disclosure shows and describes that the display recesses 110 have an extraction channel 114 that enables the collectible protector case 7 to be flush with or recessed below the top surface 103 of the base member 100. The protector case 7 can be pivoted about a pivot point to raise a far end that can be grabbed by the user to then remove the collectible case 7 from the base member 100. As shown in FIG. 7(*a*), other suitable features can be provided within the spirit and scope of the disclosure, such as transverse ridges 410, circular (or square) bumps 420, or a longitudinal ridge 430. For example, the display recess 400 has a recess bottom surface 402 that is planar, and has two or more bars or ridges 410 that extend upward along at least a portion of the recess bottom surface 402. The ridges 410 are elongated and can have a cross-section that is shaped as a square, rectangle, curved, or a half-circle. The ridges 410 are set a distance from the extreme top and bottom of the display recess 400, to provide an open area 412 for the top or bottom of the protector case to rotate. In a display position, the collectible protector case 7 rests on the top surface of the ridges, and is recessed with respect to the top surface 103.

To remove the protector case, the user presses on the top or bottom end of the protector case. The protector case pivots about the ridge 410 and the proximal end of the protector case enters the proximal open area. The distal end of the protector case rotates upward out of the display recess 400. The user can grab the distal end and remove the protector case from the display recess 400.

The bumps 420 and longitudinal ridge 430 operate in the same manner, whereby an open rotation area 412 is provided at the top and/or bottom of the display recess 400. In addition, the bumps 420 or vertical ridge 430 has open side spaces 414 to the sides of the recess 400, such that the user can press on the sides of the collectible protector case to push the side into the open side space 414 so that the opposing side of the protector case projects out of the recess 400 and can be easily grabbed by the user and removed from the recess 400. Numerous other removal features or mechanisms can be utilized where the protector case is removably received in the display recess at a recessed position to the surface, reliably held in position in the recessed display position, and easily removed from the display recess by mechanical, electrical or other mechanisms or means that eject the card protector from the display recess, with or without a pivot point. For example, an electrical solenoid can be positioned in an opening provided at one end of the recess bottom surface 402 and operated by a button to eject the card protector case. Or a mechanical spring-actuated ejector can be positioned in an opening at one end of the recess bottom surface 402. The user presses the spring ejector downward with the card protector during insertion of the card protector, and the spring stays in the depressed position. To remove the card protector, the user presses further downward on the ejector to release the spring to push the card protector out of the display recess.

In the rightmost recess of FIG. 7(*a*), yet another example of the disclosure is shown. Here, the display recess 400 has a bottom surface that is uniform and does not have a channel, bump, or ridge. Instead, a finger slot 412 is provided at one or more of the sides of the display recess 400. In the embodiment shown, a single finger slot 412 is provided at the top end of the display recess 400. The finger slot can be curved, as shown, and extend from the top surface 402 to the recess bottom 410, below the recess bottom 410, or at least partly to the recess bottom 410. In a display position, the card protector case is recessed with respect to the top surface 402. To remove the protector case, the user inserts a finger into the finger slot 412 and grabs the side or underside of the protector case and can lift the protector case out of the display recess 400. The finger slot 412 can have any suitable shape, such as a half-circle, oval, curved, square or rectangle.

Turning to FIGS. 7(*b*), 7(*c*), yet another embodiment of the base member 100 is shown. Here, the base member 600 has a top portion with a top surface 602, and a bottom portion with a bottom surface 604. The top surface 602 is front facing. The bottom surface 604 faces rearward, and can optionally have one or more storage recesses to store extra collectibles and/or collectible cases 7 (this can also be provided in any of the embodiments of FIGS. 1-7). The base member 600 also has a top end portion 610 with a top side 612, bottom end portion 630 with a bottom side 614, and an intermediate or middle portion 620 between the top and bottom end portions 610, 630. The base member 600 further has four sides, including the top side 612, the bottom side 614, a left side 616, and a right side 618. The left and right sides 616, 618 are at the middle portion 620, as well as the top and bottom end portions 610, 630. The top and bottom sides 612, 614 define a length (x-direction) of the base member 600, and the left and right sides 616, 618 extend along the height (y-direction) of the 600. FIG. 7(*b*) shows a depth of the base member 600.

The base member 600 includes one or more display recesses 650. In the embodiment shown, there are two display recesses 650. Each recess 650 has a length (x-direction) 651, height (y-direction) 653, and depth (z-direction) 655. The recess length 651 and recess depth 655 can be slightly larger than the length and depth of the collectible protector case, so that the protector case can easily slide into and out of the recess 650. The recess height 653 extends from the top side 612 of the base member 600, through the top end portion 610, to the middle portion 620, and to (or partly including) the bottom end portion 630, but does not extend to the bottom end 614, so there is foam at the bottom end of the recess 650. The recess 650 has a top recess portion 652, bottom recess portion 672, and an intermediate or middle recess portion 662. In some embodiments, the recess 650 can extend completely through the base member 600 from the top end 612 to the bottom end 614, and the middle portion 620 can have a smaller depth 655 that forms a friction fit with the protector case so that the protector case stays positioned in the recess display window 659.

The recess 650 is partially covered by a foam layer that extends about and defines a recess display window 657. The foam layer has a foam layer top portion 656, a foam layer bottom portion 674, a foam layer left side portion 657, and a foam layer right side portion 658. The foam layer top and bottom portions 656, 674 extends completely across (from a left recess side to the right recess side) at the top and bottom recess portions 652, 672, respectively. The foam left and right side portions 657, 658 extend completely from the bottom recess side to the top recess side. The foam layer bottom portion 674 and side recess portions 657, 658 partially extend into the recess 650. The foam layer top, bottom and side portions 656, 674, 657, 658 together surround and define the recess display window 659, and also define a passageway 654 beneath the foam layer top, bottom, and side portions 656, 674, 657, 658. The passageway 654 includes a top tunnel section beneath the foam layer top portion 656, where the recess 650 is surrounded on the top by the foam layer top portion 656, and on the bottom and sides by foam or padding. The passageway 654 also includes left, right and bottom passageways that extend beneath the foam layer left side, right side and bottom portions 657, 658, 674, respectively.

The recess display window 659 has a recess display length, recess display height and recess display width that is smaller than the recess length, height and width 651, 653, 655, respectively. As illustrated, the passageway 654 is elongated and formed or cut in the base member 600 along the width (FIG. 7(*b*)), toward and adjacent to (but at a distance from) the top surface 602, so that a collectible protector case 1412 can be slidably received by and into the top passageway of the passageway 654 from the top side 612, in a lengthwise manner. That is, the collectible protector case bottom forms the leading edge that enters the passageway 654. However, in other embodiments, the passageway 654 can be formed through the left and/or right side 616, 618, and the collectible protector case 1412 can be slidably received by and into the right and/or left passageways from the left and/or right sides 616, 618, respectively, in a widthwise manner. That is, the collectible protector case side forms the leading edge that enters the passageway 654. In still other embodiments, the passageway can be formed through the bottom surface 604 and received in a depth wise manner where the front face of the collectible display case is the leading surface that enters the passageway.

In the embodiments of FIGS. 7(*b*)-(*c*), the collectible cases 7 are inserted and removed from the sides of the base member, and not from the front of the recess. Thus, the frame member 200 and/or cover 300 can be permanently affixed to the base member 600 without interfering with the insertion and removal of the collectible cases 7.

It is further noted that the collectible case is shown and described as being flush with or recessed with respect to the top surface 103 of the base member 100. However, in other embodiments the collectible case 7 can project out of the recess 110 and extend above the top surface 103 of the base member 100. In those embodiments, one or more ledges or support members can be provided around the outer perimeter of the base member 100 that has a top surface that is flush or above the top surface of the collectible case 7. Or, the cover 300 can have one or more feet or ledges that extend toward the base member 100 that position the cover 300 above the collectible cases. Still further, the base member 100 need not have any recesses 110, but instead the collectibles or collectible cases 7 can be affixed or coupled to the top surface 103 of the base member, such as by an adhesive, fastener, clamp, hanger, hook, pin, clip, ledge, or other.

It is also noted that the recesses 110 retain the card or card cases 7, and that the frame 200 extends around the recesses 110. The frame 200 is directly against the top surface 103 of the base member body 102, and is not used to retain the case within the recess 110. However, in certain embodiments, the frame openings 204 can be smaller than the recesses 110, so that the cases cannot be removed from the recess 110 without the frame 200 first being removed. In addition, the base member 100 has a rear wall that has the top surface 112 and forms the channels 114 and bottom surface 116. The base member 100 is a single integral piece, with the rear wall, top wall, bottom wall, side walls, and divider walls, so that there is no gap behind the card or case 7, and the rear wall prevents the card or card case from inadvertently falling out of the back of the base member 100.

It is further noted that the device 5 is shown and described as being wall-mounted. It is noted that the device need not be wall-mounted and that other suitable uses can be provided, such as being placed on a table in a freestanding manner, or for storage or transport.

It is further noted that although one or more features and/or elements may be described herein in the context of only a single embodiment, or alternatively in the context of more than one embodiment, or further alternatively in the context of all embodiments, the features and/or elements may instead be provided separately or in any appropriate combination or not at all. Conversely, any features and/or elements described in the context of separate embodiments may alternatively be realized as existing together in the context of a single embodiment.

It is noted that the drawings may illustrate, and the description and claims may use geometric or relational terms, such as right, left, side, top, bottom, end, portion, rectangular, planar, flat, circular, sheet, rectangular, round, square, length, width, height. These terms are not intended to limit the disclosure and, in general, are used for convenience to facilitate the description based on the examples shown in the figures. For instance, though the length, height, and width are used above to refer to the x-, y-, and z-directions, respectively, the terms can be interchanged, and for example the height can refer to the x-direction and the length can refer to the y-direction. The foregoing description and drawings should be considered as illustrative only of the principles of the disclosure, which may be configured in a variety of shapes and sizes and is not intended to be limited by the embodiment herein described. Numerous applications of the disclosure will readily occur to those skilled in the art. Therefore, it is not desired to limit the disclosure to the specific examples disclosed or the exact construction and operation shown and described. Rather, all suitable modifications and equivalents may be resorted to, falling within the scope of the disclosure.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

What is claimed is:

1. A wall-mounted display device for receiving and displaying a collectible case housing a single collectible, comprising:

a discrete base member having a front surface and a plurality of recesses arranged in a plurality of rows and columns with a vertical dividing wall and a horizontal dividing wall positioned between neighboring ones of said plurality of recesses whereby each recess has four planar side walls that completely surround the recess including at least one vertical dividing wall and at least one horizontal dividing wall, each recess configured to retain a single collectible case having a single collectible by friction fit with the four side walls, and whereby the single collectible case is received and removed through the front surface;

a discrete cover removably coupled to said base member, said cover protecting the collectible case retained in said one or more recesses.

2. The display device of claim 1, further comprising:

a frame member coupled to said base member, said frame member having one or more frame openings each aligned with a respective one of the one or more recesses to surround the respective one of the one or more recesses, wherein said frame member is a flat sheet; and a frame coupling element at said frame member and removably coupling said frame member to said base member.

3. The display device of claim 2, wherein said frame member has a decorative design, color, pattern, or text message.

4. The display device of claim 1, wherein said base member and said cover each have a plurality of sides and said cover is completely disconnected from said base member on all but one side, and further comprising:

a base coupling element at said base member; and a cover coupling element at said cover and removably coupling said cover to said frame member.

5. The display device of claim 4, wherein said base coupling element comprises a first magnet, and said cover coupling element comprises a second magnet.

6. The display device of claim 5, said base member having a rear surface, and further comprising an opening in said rear surface of said base member, said first magnet received in said opening and positioned beneath the front surface of said base member.

7. The display device of claim 1, further comprising a locking element fixed to said base member and locking said cover to said base member.

8. The display device of claim 7, wherein said locking element has a biometric actuator that is operated upon detection of a biometric feature.

9. The display device of claim 8, wherein the biometric feature is a thumb print, eye scan, or face detection.

10. The display device of claim 7, further comprising a mating locking element fixed to said cover and lockably engaging said locking element of said base member.

11. The display device of claim 1, wherein the single collectible is recessed in said one or more recesses below the front surface of said base member.

12. The display device of claim 1, wherein said base member is flat and the front surface is planar, and said cover is a flat transparent sheet.

13. The display device of claim 1, further comprising a wall mounting feature fixed to said base member and configured to mount said display device to a wall structure.

14. The display device of claim 1, said device having an open configuration in which said base member and said cover are completely disconnected from one another, and a closed configuration in which said base member is removably coupled to said cover.

15. The wall-mounted display device of claim 1, wherein said base member comprises a rectangle or square having a top surface and four base member corners, said base member formed as a flat rigid board; and further comprising:

four base magnets each fixed to one of the four base member corners of said base member;

wherein said cover comprises a rectangle or square, said transparent cover completely disconnected from said base member and formed as a flat planar sheet; said cover having four cover corners; and four cover magnets each fixed to one of the four cover corners of said cover and removably coupled to a respective one of said four base magnets to removably couple and align said base member and said cover.

16. The display device of claim 1, said base member having a rear surface with an opening, a base magnet received in said opening.

17. The display device of claim 1, said base member having a side and a slot formed in the side of said base member, a base magnet received in said slot.

18. The display device of claim 1, wherein said base member is made of foam.

19. The display device of claim 1, further comprising a veneer layer or support layer affixed to the front surface of said base member.

* * * * *